US010443156B2

(12) United States Patent
Yano

(10) Patent No.: US 10,443,156 B2
(45) Date of Patent: Oct. 15, 2019

(54) YARN MANUFACTURING APPARATUS

(71) Applicant: MURATA MACHINERY, LTD., Kyoto-shi, Kyoto (JP)

(72) Inventor: Fumiaki Yano, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 783 days.

(21) Appl. No.: 14/902,277

(22) PCT Filed: Jul. 5, 2013

(86) PCT No.: PCT/JP2013/068537

§ 371 (c)(1),
(2) Date: Dec. 30, 2015

(87) PCT Pub. No.: WO2015/001669

PCT Pub. Date: Jan. 8, 2015

(65) Prior Publication Data

US 2016/0201229 A1 Jul. 14, 2016

(51) Int. Cl.

| | |
|---|---|
| ***D01H 1/115*** | (2006.01) |
| ***D01G 5/00*** | (2006.01) |
| ***D01G 23/00*** | (2006.01) |
| ***D01H 15/00*** | (2006.01) |
| ***D02G 3/16*** | (2006.01) |

(52) U.S. Cl.

CPC ..... *D01H 1/115* (2013.01); *D01G 5/00* (2013.01); *D01G 23/00* (2013.01); *D01H 15/002* (2013.01); *D02G 3/16* (2013.01); *D10B 2101/122* (2013.01)

(58) Field of Classification Search

CPC ..... D01H 1/115; D01H 15/002; D02G 3/16
See application file for complete search history.

(56) References Cited

U.S. PATENT DOCUMENTS

| | | | | |
|---|---|---|---|---|
| 4,642,978 | A | 2/1987 | Noda | |
| 9,945,053 | B2 * | 4/2018 | Yano | D02G 3/16 |
| 2007/0166223 | A1 * | 7/2007 | Jiang | B82Y 30/00 423/447.1 |
| 2008/0170982 | A1 | 7/2008 | Zhang et al. | |

(Continued)

FOREIGN PATENT DOCUMENTS

| | | |
|---|---|---|
| CN | 102953171 A | 3/2013 |
| GB | 1164612 | 9/1969 |

(Continued)

OTHER PUBLICATIONS

International Search Report dated Sep. 17, 2013 issued for corresponding PCT application PCT/JP2013/068537.

*Primary Examiner* — Shaun R Hurley
(74) *Attorney, Agent, or Firm* — DLA Piper LLP (US)

(57) ABSTRACT

A yarn producing apparatus that produces high-density carbon nanotube yarn at high speed. The yarn producing apparatus includes: a substrate support supporting a carbon nanotube (CNT) forming substrate; a winding device configured to continuously draw CNT fibers from the CNT forming substrate supported on the substrate support and to allow the CNT fibers to run; and a yarn producing unit provided between the substrate support and the winding device to directly take in the CNT fibers drawn by the winding device and twist the taken-in CNT fibers. The yarn producing unit false-twists the CNT fibers with a swirl flow of compressed air.

5 Claims, 5 Drawing Sheets

(56) References Cited

U.S. PATENT DOCUMENTS

| | | | | |
|---|---|---|---|---|
| 2015/0147573 | A1 | 5/2015 | Zhang et al. | |
| 2015/0308018 | A1 | 10/2015 | Zhang et al. | |
| 2016/0083872 | A1 | 3/2016 | Zhang et al. | |
| 2016/0201230 | A1* | 7/2016 | Yano | D01H 1/115 118/44 |
| 2016/0251778 | A1 | 9/2016 | Zhang et al. | |
| 2016/0273133 | A1 | 9/2016 | Zhang et al. | |
| 2016/0312387 | A1 | 10/2016 | Zhang et al. | |
| 2017/0001866 | A1 | 1/2017 | Zhang et al. | |
| 2017/0096750 | A1 | 4/2017 | Zhang et al. | |
| 2017/0137290 | A1 | 5/2017 | Zhang et al. | |

FOREIGN PATENT DOCUMENTS

| | | | |
|---|---|---|---|
| JP | 2008523254 | A | 7/2008 |
| WO | 2007015710 | A2 | 2/2007 |
| WO | 2008022129 | A2 | 2/2008 |

* cited by examiner

YARN MANUFACTURING APPARATUS

CROSS REFERENCE TO RELATED APPLICATIONS

This application is a national stage of international application no. PCT/JP2013/068537, filed on Jul. 5, 2013, which is incorporated herein by reference.

TECHNICAL FIELD

The present invention relates to a yarn producing apparatus for producing carbon nanotube yarn.

BACKGROUND ART

A known example of a conventional yarn producing apparatus for producing carbon nanotube yarn is disclosed, for example, in Patent Literature 1. In the yarn producing apparatus disclosed in Patent Literature 1, nanotube fibers are drawn from a nanotube forest (carbon nanotube assembly) provided on a substrate and then false-twisted by a spinneret.

CITATION LIST

Patent Literature

[Patent Literature 1] Japanese Unexamined Patent Application Publication (Translation of PCT Application) No. 2008-523254

SUMMARY OF INVENTION

Technical Problem

In a general yarn producing apparatus that spins fiber such as cotton, the fiber is introduced into the yarn producing unit through rollers. Fiber of carbon nanotubes has the property of easily aggregating and retains its shape once aggregated. For this reason, the carbon nanotube fibers are compressed and aggregated into the form of a strip when passing through the rollers, and retain the shape. In this case, the carbon nanotube fibers aggregated in the form of a strip are twisted in the yarn producing unit, as a result, low-density yarn including voids is produced.

In this respect, the yarn producing apparatus disclosed in Patent Literature 1 has a configuration effective in preventing low yarn density because the carbon nanotube fibers are introduced into the spinneret directly from the nanotube forest. It is, however, difficult to increase the speed of producing carbon nanotube yarn with the yarn producing apparatus in Patent Literature 1 because the carbon nanotube fibers are twisted by the spinneret.

An object of the present invention is to provide a yarn producing apparatus capable of producing high-density carbon nanotube yarn at high speed.

Solution to Problem

A yarn producing apparatus according to an aspect of the present invention produces carbon nanotube yarn from carbon nanotube fibers while allowing the carbon nanotube fibers to run. The yarn producing apparatus includes a support configured to support a carbon nanotube assembly, a drawing unit configured to continuously draw the carbon nanotube fibers from the carbon nanotube assembly supported on the support and to allow the carbon nanotube fibers to run, and a yarn producing unit provided between the support and the drawing unit to directly take in the carbon nanotube fibers drawn by the drawing unit and twist the taken-in carbon nanotube fibers. The yarn producing unit false-twists the carbon nanotube fibers with a swirl flow of compressed air.

In this yarn producing apparatus, the yarn producing unit directly takes in the carbon nanotube fibers drawn by the drawing unit and false-twists the taken-in carbon nanotube fibers. That is, the carbon nanotube fibers drawn from the carbon nanotube assembly are directly introduced into the yarn producing unit without passing through rollers or other parts. The yarn producing apparatus thus can produce high-density carbon nanotube yarn because the carbon nanotube fibers in a state of having a non-flat shape are twisted. In the yarn producing apparatus, the carbon nanotube fibers are twisted by a swirl flow of the compressed air. The yarn producing apparatus therefore can produce carbon nanotube yarn from the carbon nanotube fibers at high speed.

In an embodiment, the drawing unit may include a nip roller unit including a pair of rollers. In the configuration in which carbon nanotube fibers are twisted by a swirl flow of the compressed air, a balloon is generated in the carbon nanotube fibers (twisted yarn) output from the yarn producing unit. In this case, it is difficult to wind the yarn stably in the presence of the balloon. The yarn producing apparatus therefore includes the nip roller unit. In the yam producing apparatus with this configuration, the nip roller unit stops the balloon (stops twisting) of yarn output from the yarn producing unit. In the yarn producing apparatus, therefore, the yarn can be stably wound.

In an embodiment, the distance between the carbon nanotube assembly supported on the support and the yarn producing unit may be smaller than the distance between the yarn producing unit and the nip roller unit. In the yarn producing apparatus, the distance between the carbon nanotube assembly and the yam producing unit is shortened, whereby the twisting in the yarn producing unit effectively acts on the carbon nanotube fibers drawn from the carbon nanotube assembly. The yam producing apparatus therefore can produce excellent carbon nanotube yarn.

In an embodiment, the yarn producing unit may include a nozzle body configured to allow the carbon nanotube fibers to pass through, a first nozzle provided in the nozzle body to generate a first swirl flow, with compressed air, in a direction orthogonal to a direction of the carbon nanotube fibers running, and a second nozzle provided in the nozzle body to generate a second swirl flow, with compressed air, in a direction orthogonal to the direction of the carbon nanotube fibers running and opposite to the direction of the first swirl flow. The first nozzle and the second nozzle may be provided at positions different in the direction of the carbon nanotube fibers running in the nozzle body. In this yarn producing apparatus, the first nozzle generates a first swirl flow, and the second nozzle generates a second swirl flow in a direction opposite to the direction of the first swirl flow. In the yam producing apparatus, therefore, the carbon nanotube fibers can be stably false-twisted at high speed.

In an embodiment, the first nozzle may be provided on an upstream side from the second nozzle in the direction of the carbon nanotube fibers running. The pressure of the compressed air for forming the first swirl flow may be lower than the pressure of the compressed air for forming the second swirl flow. In this configuration having the first nozzle provided on the upstream side from the second nozzle, the pressure of the compressed air for forming the first swirl flow is reduced, that is, the pressure of the compressed air for forming the second swirl flow is increased, so that the carbon nanotube fibers can be false-twisted excellently.

In an embodiment, the first swirl flow generated in the first nozzle may mainly twine part of an outer surface of the carbon nanotube fibers, and the second swirl flow generated in the second nozzle may mainly false-twist the carbon nanotube fibers to aggregate the carbon nanotube fibers. In the yarn producing apparatus with this configuration, the carbon nanotube fibers can be false-twisted excellently.

In an embodiment, the nozzle body may have an air escape portion between the first nozzle and the second nozzle. This configuration can eliminate or minimize the interference between the first swirl flow in the first nozzle and the second swirl flow in the second nozzle in the yarn producing apparatus. Disturbances in the swirl flow in each nozzle thus can be eliminated or minimized, leading to improvement in quality of carbon nanotube yarn.

In an embodiment, the air escape portion may be a notch cut in the nozzle body. In the yarn producing apparatus with this configuration, the nozzle body excluding the notch can minimize or eliminate scattering of the carbon nanotube fibers.

Advantageous Effects of Invention

The present invention can produce high-density carbon nanotube yarn at high speed.

DESCRIPTION OF EMBODIMENT

A preferred embodiment of the present invention will be described in detail below with reference to the accompanying drawings. It should be noted that the same or corresponding elements are denoted with the same reference signs in the description of the drawings and an overlapping description will be omitted.

Figure 1:
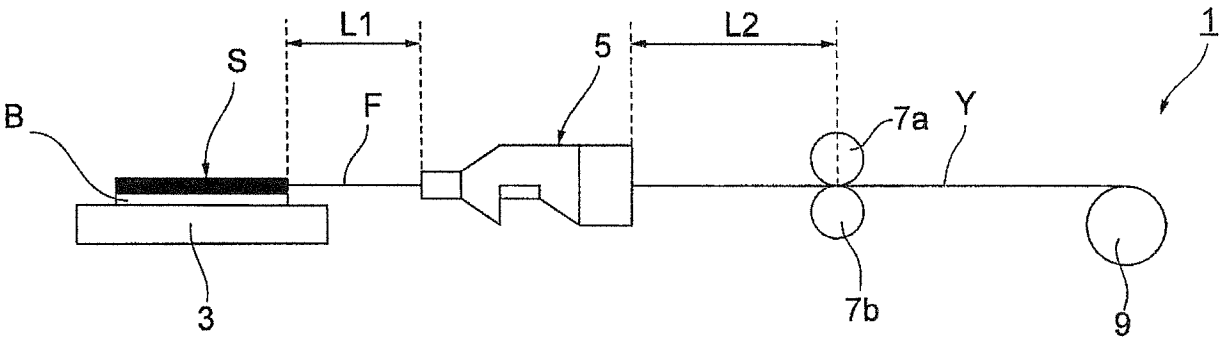
FIG. 1 is a diagram illustrating a yarn producing apparatus according to an embodiment.
Figure 2:
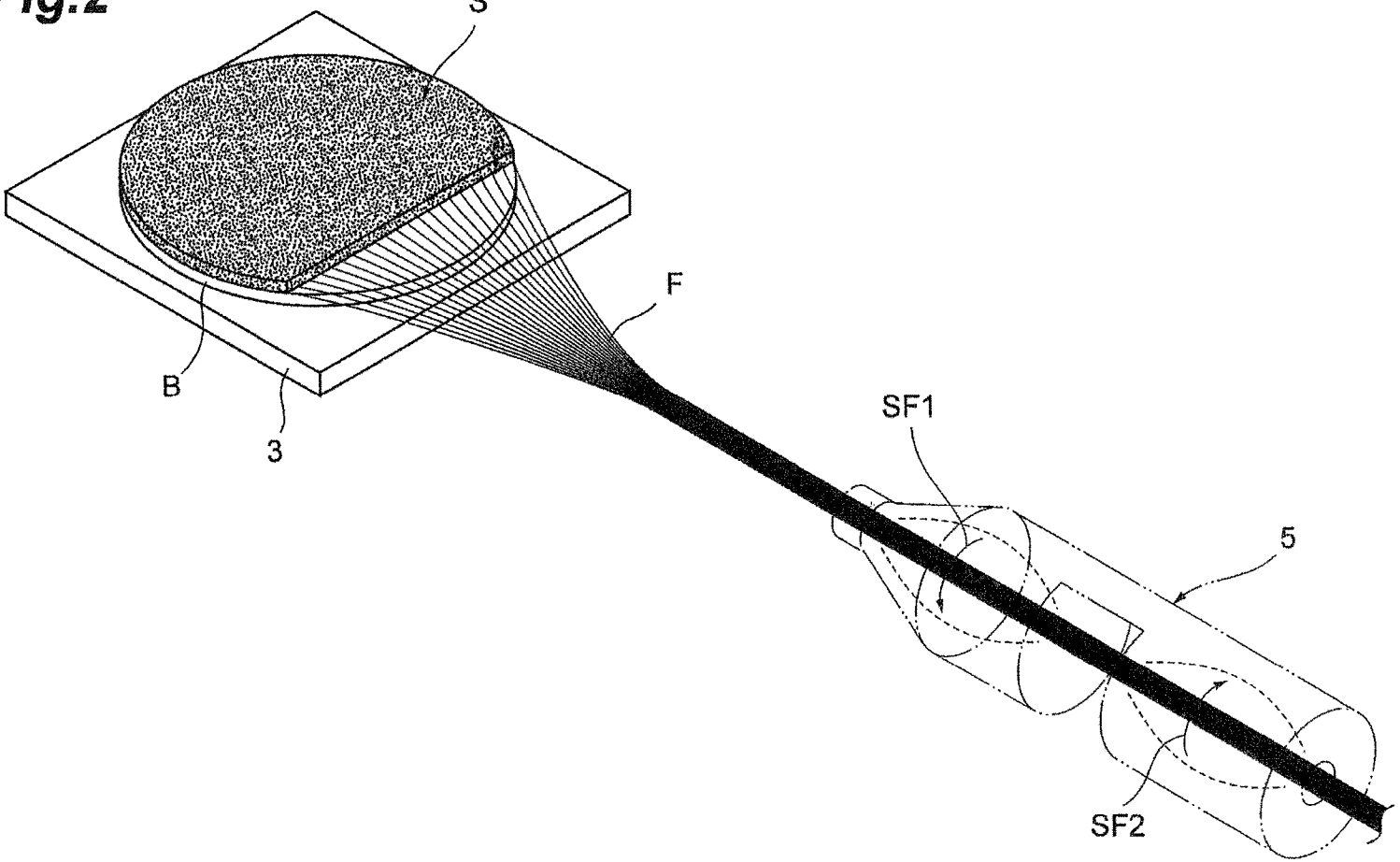
FIG. 2 is a partial perspective view of the yarn producing apparatus shown in FIG. 1.

FIG. 1 is a diagram illustrating a yarn producing apparatus according to an embodiment. FIG. 2 is a partial perspective view of the yarn producing apparatus shown in FIG. 1. As shown in the drawings, a yarn producing apparatus 1 is an apparatus for producing carbon nanotube yam (hereinafter referred to as "CNT yarn") Y from carbon nanotube fibers (hereinafter referred to as "CNT fibers") F while allowing the CNT fibers F to run.

The yarn producing apparatus 1 includes a substrate support (support) 3, a yarn producing unit 5, and a drawing unit. The drawing unit includes nip rollers 7*a*, 7*b*, and a winding device 9. The substrate support 3, the yarn producing unit 5, the nip rollers 7*a*, 7*b*, and the winding device 9 are arranged in this order on a predetermined line. The CNT fibers F run from the substrate support 3 toward the winding device 9. The CNT fibers F are a set of a plurality of fibers of carbon nanotube. The CNT yarn Y is the false-twisted and aggregated CNT fibers F.

The substrate support 3 supports a carbon nanotube-forming substrate (hereinafter referred to as "CNT forming substrate") S from which the CNT fibers F are drawn, in a state of holding the CNT forming substrate S. The CNT forming substrate S is a carbon nanotube assembly called a carbon nanotube forest or a vertically aligned carbon nanotube structure, in which high-density and high-oriented carbon nanotubes (for example, single-wall carbon nanotubes, double-wall carbon nanotubes, or multi-wall carbon nanotubes) are formed on a substrate B by chemical vapor deposition or any other process. Examples of the substrate B include a plastic substrate, a glass substrate, a silicon substrate, and a metal substrate. For example, at the start of production of CNT yarn Y or during replacement of the CNT forming substrates S, a tool called a microdrill can be used to draw the CNT fibers F from the CNT forming substrate S.

Figure 3:
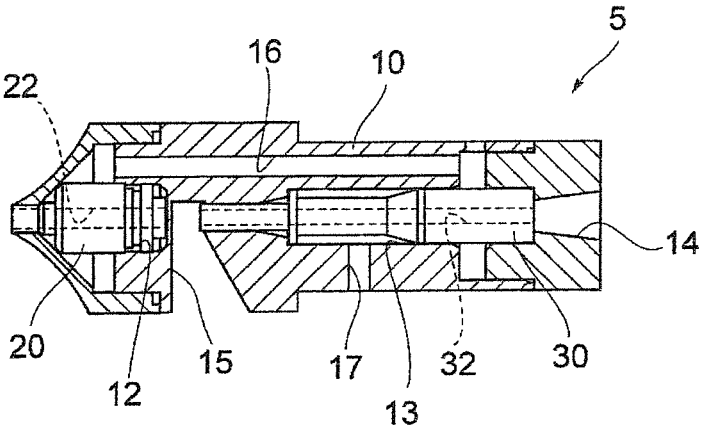
FIG. 3 is a diagram illustrating a yarn producing unit.
Figure 4:
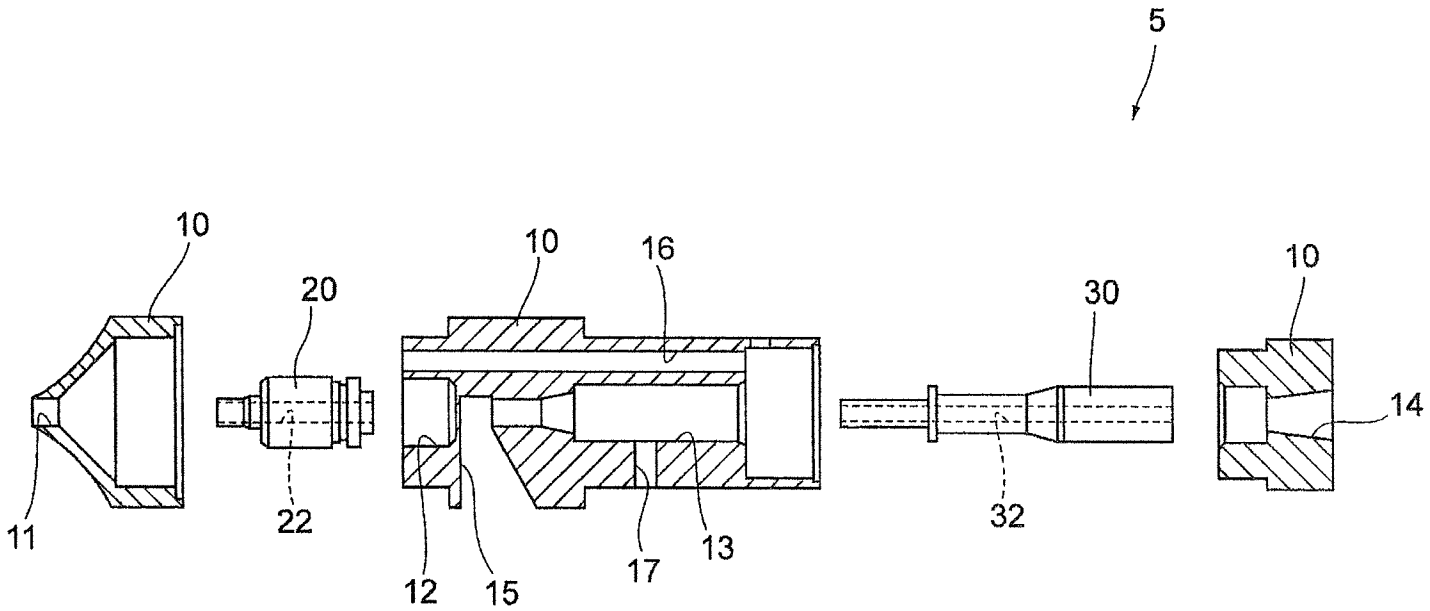
FIG. 4 is an exploded view of the yarn producing unit shown in FIG. 3.

The yarn producing unit 5 false-twists the CNT fibers F with a swirl flow of the compressed air (air) to aggregate the CNT fibers F. FIG. 3 is a diagram illustrating the yarn producing unit. FIG. 4 is an exploded view of the yarn producing unit shown in FIG. 3. In FIG. 3 and FIG. 4, a nozzle body 10 is illustrated in cross section. As shown in FIG. 3 and FIG. 4, the yarn producing unit 5 includes a nozzle body 10, a first nozzle 20, and a second nozzle 30. The first nozzle 20 and the second nozzle 30 are provided in the nozzle body 10. The nozzle body 10, the first nozzle 20, and the second nozzle 30 form a unit.

The nozzle body 10 is a housing that allows the CNT fibers F to pass through and holds the first nozzle 20 and the second nozzle 30 therein. The nozzle body 10 is formed of, for example, brass or any other material. The nozzle body 10 has an inlet 11 that allows the CNT fibers F to pass through and through which the CNT fibers F are introduced into the nozzle body 10, a first compartment 12 that accommodates the first nozzle 20, a second compartment 13 that accommodates the second nozzle 30, and an outlet 14 that allows the CNT fibers F to pass through and through which the CNT fibers F are output from the nozzle body 10. The first compartment 12 and the second compartment 13 are arranged in the direction of the CNT fibers F running.

The first compartment 12 is provided on one end in the direction of the CNT fibers F running (the position on the upstream side in the direction of the CNT fibers F running, in the yarn producing unit 5 arranged as shown in FIG. 1). The second compartment 13 is provided on the other end in the direction of the CNT fibers F running (the position on the downstream side from the first compartment 12, in the yarn producing unit 5 arranged as shown in FIG. 1).

An air escape portion 15 is arranged between the first compartment 12 and the second compartment 13. The air escape portion 15 lets out a first swirl flow SF1 generated in the first nozzle 20. The air escape portion 15 is a notch cut in the nozzle body 10. The air escape portion 15 is provided so as to include a path through which the CNT fibers F run. The path of the CNT fibers F between the first compartment 12 and the second compartment 13 is in communication with the air escape portion 15 and is partially covered with the nozzle body 10.

The nozzle body 10 has a first channel 16 and a second channel 17. The first channel 16 is a channel in communication with the first compartment 12 to supply the compressed air to the first nozzle 20. The second channel 17 is a channel in communication with the second compartment 13 to supply the compressed air to the second nozzle 30. Although the nozzle body 10 is configured with a plurality of (here, three) parts in the present embodiment, the nozzle body 10 may be formed in one piece.

Figure 5:
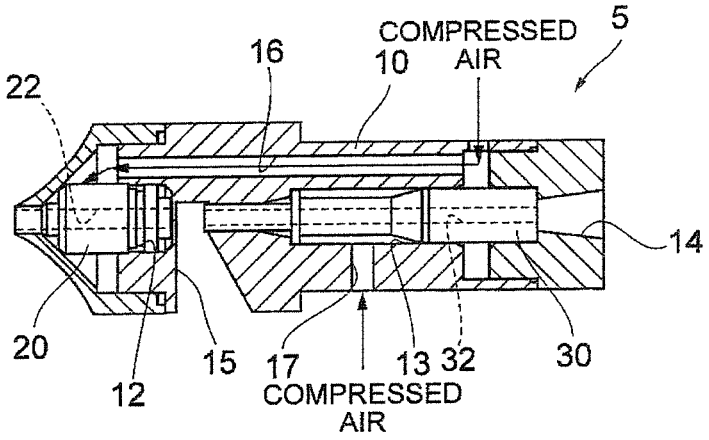
FIG. 5 is a diagram illustrating air flows in the yarn producing unit.

The first nozzle 20 generates a first swirl flow SF1 to form a balloon in the CNT fibers F and twist the CNT fibers F. The first nozzle 20 is formed of, for example, ceramics. The first nozzle 20 is arranged in the first compartment 12 of the nozzle body 10. The first nozzle 20 has a tubular portion 22 that allows the CNT fibers F to pass through and defines a space in which the first swirl flow SF1 is generated. The tubular portion 22 is provided in the direction of the CNT fibers F running, The first nozzle 20 is supplied with the compressed air from a not-shown air supply source through the first channel 16 in the nozzle body 10, as shown in FIG. 5. In the first nozzle 20, as shown in FIG. 2, a first swirl flow SF1 is generated in the direction orthogonal to the direction of the CNT fibers F running, for example, counterclockwise around the running direction. The first swirl flow SF1 is generated along the inner wall of the tubular portion 22. The first swirl flow SF1 mainly twines the outside fibers (part of the outer layer) of the CNT fibers F, around the inside fibers. The pressure (static pressure) of the compressed air for forming the first swirl flow SF1 is, for example, about 0.25 MPa.

The second nozzle 30 generates a second swirl flow SF2 to form a balloon in the CNT fibers F and twist the CNT fibers F. The second nozzle 30 is formed of for example, ceramics. The second nozzle 30 is arranged in the second compartment 13 of the nozzle body 10. The second nozzle 30 has a tubular portion 32 that allows the CNT fibers F to pass through and defines a space in which the second swirl flow SF2 is generated. The tubular portion 32 is provided in the direction of the CNT fibers F running.

The second nozzle 30 is supplied with the compressed air from a not-shown air supply source through the second channel 17 in the nozzle body 10, as shown in FIG. 5. In the second nozzle 30, as shown in FIG. 2, a second swirl flow SF2 is generated in the direction orthogonal to the direction of the CNT fibers F running and opposite to the direction of the first swirl flow SF1, for example, clockwise around the running direction. That is, the direction of the second swirl flow SF2 is opposite to the direction of the first swirl flow SF1. The second swirl flow SF2 is generated along the inner wall of the tubular portion 32. The second swirl flow SF2 mainly twists the core (the inside fibers) of the CNT fibers F in the direction opposite to the direction of the first swirl flow SF1. The pressure (static pressure) of the compressed air for forming the second swirl flow SF2 is, for example, about 0.4 to 0.6 MPa. That is, the pressure of the compressed air for forming the second swirl flow SF2 is higher than the pressure of the compressed air for forming the first swirl flow SF1. In other words, the pressure of the compressed air for forming the first swirl flow SF1 is lower than the pressure of the compressed air for forming the second swirl flow SF2.

The nip rollers 7*a*, 7*b* convey the aggregated CNT yarn Y false-twisted by the yarn producing unit 5. A pair of nip rollers 7*a*, 7*b* is arranged at a position at which the CNT yarn Y is sandwiched. The nip rollers 7*a*, 7*b* stop the twisting (balloon) of the CNT fibers F that propagates from the yarn producing unit 5. The CNT fibers F false-twisted by the yarn producing unit 5 pass through the nip rollers 7*a*, 7*b* to be further aggregated, yielding the CNT yarn Y, which is the final product.

In the present embodiment, as shown in FIG. 1, the distance L1 between the CNT forming substrate S and the yarn producing unit 5 is smaller than the distance L2 between the yam producing unit 5 and the nip rollers 7*a*, 7*b* (L1<L2). That is, the yarn producing unit 5 is arranged at a position near the CNT forming substrate S.

The winding device 9 winds, around a bobbin, the CNT yarn Y that has been false-twisted by the yarn producing unit 5 and passed through the nip rollers 7*a*, 7*b*. The winding device 9 draws the CNT fibers F from the CNT forming substrate S and allows the CNT fibers F to run.

The method of producing CNT yarn Y in the yarn producing apparatus 1 will now be described. First, the winding device 9 draws the CNT fibers F from the CNT forming substrate S supported on the substrate support 3. The drawn CNT fibers F are directly introduced into the yarn producing unit 5. The CNT fibers F introduced into the yarn producing unit 5 start being twisted by the second swirl flow SF2 in the second nozzle 30 of the yarn producing unit 5. The aggregated CNT fibers F twisted by the second swirl flow SF2 are untwisted by the first swirl flow SF1 in the first nozzle 20. Part (outer surface) of the CNT fibers F not aggregated by the second swirl flow SF2 is twined around the aggregated surface by the first swirl flow SF1 in the first nozzle 20. The yarn producing unit 5 thus aggregates the CNT fibers F. The CNT fibers F twisted by the yarn producing unit 5 are formed into the CNT yarn Y, which in turn is wound around a bobbin by the winding device 9. The yarn producing apparatus 1 produces the CNT yarn Y, for example, at a rate of a few tens of meters per minute.

As described above, in the yarn producing apparatus 1 according to the present embodiment, the yarn producing unit 5 directly takes in the CNT fibers F drawn by the winding device 9 and twists the taken-in CNT fibers F. That is, the CNT fibers F drawn from the CNT forming substrate S are directly introduced into the yarn producing unit 5 without passing through rollers or other parts. The yarn producing apparatus 1 therefore produces high-density CNT yam Y because the CNT fibers F in a state of having a non-flat shape (strip) (in a not-aggregated state) are twisted. In the yarn producing apparatus 1, the CNT fibers F are twisted by a swirl flow of the compressed air. The yam producing apparatus 1 thus can produce the CNT yarn Y from the CNT fibers F at high speed.

In the present embodiment, the nip rollers 7*a*, 7*b* are arranged between the yarn producing unit 5 and the winding device 9. In the configuration in which the CNT fibers F are twisted by a swirl flow of the compressed air, a balloon is generated in the CNT fibers F output from the yarn producing unit 5. In this case, it is difficult for the winding device 9 to wind the yarn stably in the presence of the balloon. In the yarn producing apparatus 1, therefore, the nip rollers 7*a*, 7*b* are arranged between the yarn producing unit 5 and the winding device 9. In the yarn producing apparatus 1 with this configuration, the nip rollers 7*a*, 7*b* can stop the balloon (stop twisting) of yarn output from the yarn producing unit 5. In the yarn producing apparatus 1, therefore, the CNT yarn Y can be stably wound.

In the present embodiment, the distance between the CNT forming substrate S supported on the substrate support 3 and the yarn producing unit 5 is smaller than the distance between the yarn producing unit 5 and the nip rollers 7*a*, 7*b*. In the yarn producing apparatus 1, the distance between the CNT forming substrate S and the yarn producing unit 5 is shortened, whereby the twisting in the yam producing unit 5 effectively acts on the CNT fibers F drawn from the CNT forming substrate S. The yarn producing apparatus 1 therefore can produce excellent CNT yarn Y.

In the yarn producing apparatus 1 of the present embodiment, the first nozzle 20 generates a first swirl flow SF1, and the second nozzle 30 generates a second swirl flow SF2 in the direction opposite to the direction of the first swirl flow SF1. In the yam producing apparatus 1 with this configuration, the CNT fibers F can be false-twisted at high speed.

In the yarn producing apparatus 1, a swirl flow is generated by the compressed air to twist the CNT fibers F. With this configuration, the twist state can be easily adjusted by adjusting the amount of compressed air. In the yarn producing apparatus 1, the first nozzle 20 and the second nozzle 30 are each provided in the nozzle body 10 to form a unit and are arranged at different positions in the direction of the CNT fibers F running. This configuration can facilitate passage of the CNT fibers F through the first nozzle 20 and the second nozzle 30 in the yarn producing apparatus 1.

In the present embodiment, the first nozzle 20 is arranged on the upstream side from the second nozzle 30 in the direction of the CNT fibers F running. In such a configuration, the pressure of the compressed air for forming the first swirl flow SF1 is lower than the pressure of the compressed air for forming the second swirl flow SF2. In the yarn producing apparatus 1 with this configuration, the first swirl flow SF1 generated in the first nozzle 20 mainly twines part of the outside of the CNT fibers F, whereas the second swirl flow SF2 generated in the second nozzle 30 mainly twists the CNT fibers F. In the yarn producing apparatus 1, therefore, the CNT fibers F can be false-twisted excellently, thereby being aggregated.

In the present embodiment, the air escape portion 15 is provided between the first nozzle 20 and the second nozzle 30 in the nozzle body 10. The air escape portion 15 is a notch cut in the nozzle body 10. This configuration can eliminate or minimize the interference between the first swirl flow SF1 in the first nozzle 20 and the second swirl flow SF2 in the second nozzle 30 in the yarn producing unit 5. In the yarn producing unit 5, therefore, disturbances in swirl flows SF1, SF2 in the nozzles 20, 30, respectively, can be minimized or eliminated, leading to improvement in the quality of the CNT yarn Y. In the yarn producing unit 5, the nozzle body 10 excluding the air escape portion 15 can eliminate or minimize scattering of the CNT fibers F.

The present invention is not intended to be limited to the foregoing embodiment. In place of the CNT forming substrate S, for example, a floating catalyst apparatus that continuously synthesizes carbon nanotubes to supply the CNT fibers F may be used as the supply source of the CNT fibers F.

In the foregoing embodiment, the distance L1 between the CNT forming substrate S and the yarn producing unit 5 is smaller than the distance L2 between the yarn producing unit 5 and the nip rollers 7*a*, 7*b* (L1<L2). However, this configuration is given only for illustration, and the distance L1 between the CNT forming substrate S and the yarn producing unit 5 may be equal to the distance L2 between the yarn producing unit 5 and the nip rollers 7*a*, 7*b*. Alternatively, the distance L1 between the CNT forming substrate S and the yam producing unit 5 may be greater than the distance L2 between the yarn producing unit 5 and the nip rollers 7*a*, 7*b*.

In the foregoing embodiment described by way of example, the pressure of the compressed air for forming the first swirl flow SF1 is set lower than the pressure of the compressed air for forming the second swirl flow SF2. However, the respective pressures of the compressed airs for forming the first swirl flow and for forming the second swirl flow SF2 may be equal. Alternatively, the pressure of the compressed air for forming the second swirl flow SF2 may be set lower than the pressure of the compressed air for forming the first swirl flow SF1.

In the foregoing embodiment, the configuration in which the first nozzle 20 and the second nozzle 30 are arranged in the nozzle body 10 has been described, by way of example. However, the first nozzle and the second nozzle may be spaces formed in the nozzle body 10. That is, the configuration equivalent to the first nozzle 20 and the second nozzle 30 may be integrally formed in the nozzle body 10.

INDUSTRIAL APPLICABILITY

The present invention can provide a yarn producing apparatus capable of producing high-density carbon nanotube yarn at high speed.

REFERENCE SIGNS LIST

1 . . . yarn producing apparatus, 3 . . . substrate support (support), 5 . . . yarn producing unit, 7*a*, 7*b* . . . nip roller, 9 . . . winding device (drawing unit), 10 . . . nozzle body, 15 . . . air escape portion, 20 . . . first nozzle, 30 . . . second nozzle, F . . . CNT fibers (carbon nanotube fibers), S . . . CNT forming substrate (carbon nanotube assembly), SF1 . . . first swirl flow, SF2 . . . second swirl flow, Y . . . CNT yarn (carbon nanotube yarn).

The invention claimed is:

1. A yarn producing apparatus for producing carbon nanotube yarn from non-aggregated carbon nanotube fibers while allowing the carbon nanotube fibers to run, the yarn producing apparatus comprising:

a support configured to support a carbon nanotube assembly;

a drawing unit configured to continuously draw non-aggregated carbon nanotube fibers from the carbon nanotube assembly supported on the support and to allow the non-aggregated carbon nanotube fibers to run; and a yarn producing unit provided between the support and the drawing unit to directly take in the non-aggregated carbon nanotube fibers drawn by the drawing unit and twist the taken-in carbon nanotube fibers, wherein the yarn producing unit false-twists the carbon nanotube fibers with a swirl flow of compressed air, wherein the yarn producing unit includes a nozzle body configured to allow the carbon nanotube fibers to pass through, a first nozzle provided in the nozzle body to generate a first swirl flow, with compressed air, in a direction orthogonal to a direction of the carbon nanotube fibers running, and a second nozzle provided in the nozzle body to generate a second swirl flow, with compressed air, in the direction orthogonal to the direction of the carbon nanotube fibers running and opposite to the direction of the first swirl flow, the first nozzle and the second nozzle are provided at positions different in the direction of the carbon nanotube fibers running in the nozzle body, the first nozzle and the second nozzle aggregate the non-aggregated carbon nanotube fibers, the drawing unit includes a nip roller unit including a pair of rollers, and a distance between the carbon nanotube assembly supported on the support and the yarn producing unit is smaller than a distance between the yarn producing unit and the nip roller unit.

2. The yarn producing apparatus according to claim 1, wherein the first nozzle is provided on an upstream side from the second nozzle in the direction of the carbon nanotube fibers running, and a pressure of the compressed air for forming the first swirl flow is lower than a pressure of the compressed air for forming the second swirl flow.

3. The yarn producing apparatus according to claim 1, wherein the first swirl flow generated in the first nozzle mainly twines part of an outer layer of the carbon nanotube fibers, and the second swirl flow generated in the second nozzle mainly false-twists the carbon nanotube fibers to aggregate the carbon nanotube fibers.

4. The yarn producing apparatus according to claim 1, wherein the nozzle body has an air escape portion between the first nozzle and the second nozzle.

5. The yarn producing apparatus according to claim 4, wherein the air escape portion is a notch cut in the nozzle body.

* * * * *